US011078563B2

(12) United States Patent
Kubushiro et al.

(10) Patent No.: US 11,078,563 B2
(45) Date of Patent: Aug. 3, 2021

(54) TIAL ALLOY AND METHOD OF MANUFACTURING THE SAME

(71) Applicant: IHI Corporation, Koto-ku (JP)

(72) Inventors: Keiji Kubushiro, Tokyo (JP); Satoshi Takahashi, Tokyo (JP)

(73) Assignee: IHI Corporation, Koto-ku (JP)

( * ) Notice: Subject to any disclaimer, the term of this patent is extended or adjusted under 35 U.S.C. 154(b) by 0 days.

(21) Appl. No.: 16/212,997

(22) Filed: Dec. 7, 2018

(65) Prior Publication Data

US 2019/0106778 A1 Apr. 11, 2019

Related U.S. Application Data

(63) Continuation of application No. PCT/JP2017/029834, filed on Aug. 22, 2017.

(30) Foreign Application Priority Data

Sep. 2, 2016 (JP) ..... JP2016-171513

(51) Int. Cl.

| | |
|---|---|
| ***C22C 14/00*** | (2006.01) |
| ***F01D 5/28*** | (2006.01) |
| ***C22F 1/18*** | (2006.01) |
| ***C22F 1/02*** | (2006.01) |

(52) U.S. Cl.

CPC ..... *C22F 1/183* (2013.01); *C22C 14/00* (2013.01); *C22F 1/02* (2013.01); *F01D 5/28* (2013.01); *F01D 5/282* (2013.01); *F05D 2220/323* (2013.01); *F05D 2240/24* (2013.01); *F05D 2300/174* (2013.01)

(58) Field of Classification Search

CPC . C22C 21/003; C22C 14/00; F05D 2300/174; C22F 1/183

See application file for complete search history.

(56) References Cited

U.S. PATENT DOCUMENTS

| | | | | |
|---|---|---|---|---|
| 5,076,858 | A | 12/1991 | Huang | |
| 2004/0045644 | A1* | 3/2004 | Guther | C22C 14/00 148/538 |
| 2006/0102255 | A1* | 5/2006 | Woodfield | C22C 32/0021 148/421 |
| 2009/0151822 | A1* | 6/2009 | Appel | C22C 1/0491 148/549 |
| 2010/0000635 | A1 | 1/2010 | Appel et al. | |

(Continued)

FOREIGN PATENT DOCUMENTS

| | | | |
|---|---|---|---|
| CN | 101056998 | A | 10/2007 |
| CN | 101457314 | A | 6/2009 |

(Continued)

OTHER PUBLICATIONS

JP2001271165A English language translation (Year: 2001).*

(Continued)

*Primary Examiner* — Anthony J Zimmer
*Assistant Examiner* — Sean P. O'Keefe
(74) *Attorney, Agent, or Firm* — Oblon, McClelland, Maier & Neustadt, L.L.P.

(57) ABSTRACT

A TiAl alloy for forging, contains 41 at % or more and 44 at % or less of Al, 4 at % or more and 6 at % or less of Nb, 4 at % or more and 6 at % or less of V, 0.1 at % or more and 1 at % or less of B, and the balance being Ti and inevitable impurities.

13 Claims, 5 Drawing Sheets

(56) References Cited

U.S. PATENT DOCUMENTS

| | | | | |
|---|---|---|---|---|
| 2010/0015005 | A1 | 1/2010 | Oehring et al. | |
| 2010/0316525 | A1* | 12/2010 | Shindo | B21J 5/00 420/420 |
| 2011/0146853 | A1* | 6/2011 | Miracle | C22C 14/00 148/564 |
| 2014/0010701 | A1 | 1/2014 | Appel et al. | |
| 2014/0202601 | A1* | 7/2014 | Helm | C22C 14/00 148/670 |
| 2015/0275673 | A1* | 10/2015 | Koyanagi | F01D 5/28 416/241 R |
| 2016/0145703 | A1 | 5/2016 | Tetsui | |
| 2016/0265096 | A1 | 9/2016 | Janschek et al. | |

FOREIGN PATENT DOCUMENTS

| | | | |
|---|---|---|---|
| DE | 10 2015 103 422 | B3 | 7/2016 |
| EP | 0 275 391 | A1 | 7/1988 |
| EP | 2 075 349 | A2 | 7/2009 |
| EP | 2 251 445 | A1 | 11/2010 |
| JP | 6-41661 | | 2/1994 |
| JP | 8-144034 | | 6/1996 |
| JP | 3106196 | B1 | 11/2000 |
| JP | 2000-355706 | | 12/2000 |
| JP | 2001271165 | A * | 11/2001 |
| JP | 2002-3977 | | 1/2002 |
| JP | 2003-533594 | | 11/2003 |
| JP | 2009-114513 | | 5/2009 |
| JP | 2009-144247 | | 7/2009 |
| JP | 2009-215631 | | 9/2009 |
| JP | 2009-256802 | | 11/2009 |
| JP | 2011-52239 | | 3/2011 |
| JP | 2015-4092 | | 1/2015 |
| JP | 2016-166418 | | 9/2016 |

OTHER PUBLICATIONS

International Search Report dated Nov. 21, 2017 in PCT/JP2017/029834, filed on Aug. 22, 2017.

Written Opinion dated Nov. 21, 2017 in PCT/JP2017/029834, filed on Aug. 22, 2017.

Combined Chinese Office Action and Search Report dated May 15, 2020, in Patent Application No. 201780038575.4, 9 pages (with English Translation of Category of Cited Documents).

Extended European Search Report dated Dec. 9, 2019 in European Patent Application No. 17846194.3, 12 pages.

Nakashima, H. et al. "Phase stability of beta-Ti Phase in the TiAl Alloys with the Combined Addition of M Elements", Materials Research Society Symposium Proceedings, XP055647932, vol. 1760, Dec. 31, 2015, 6 pages.

Kong, F. et al. "Microstructure and Mechanical Properties of TiAl Alloys Produced by Powder Metallurgy", Gamma Titanium Aluminide Alloys, TMS (The Minerals, Metals & Materials Society), XP055647936, Dec. 31, 2014, pp. 203-205.

* cited by examiner

TIAL ALLOY AND METHOD OF MANUFACTURING THE SAME

CROSS REFERENCE TO RELATED APPLICATIONS

This application is a continuation application of International Application No. PCT/JP2017/029834, filed on Aug. 22, 2017, which claims priority to Japanese Patent Application No. 2016-171513, filed on Sep. 2, 2016, the entire contents of which are incorporated by references herein.

BACKGROUND

1. Field

The present disclosure relates to a TiAl alloy and a method of manufacturing the same, and particularly to a TiAl alloy for forging and a method of manufacturing the same.

2. Description of the Related Art

TiAl alloys (titanium aluminides) are alloys formed from intermetallic compounds of Ti and Al. TiAl alloys are excellent in heat resistance, and have lighter weights and larger specific strengths than Ni alloys. For these reasons, TiAl alloys are used for aircraft engine components such as a turbine blade. TiAl alloys have low ductility, and are hard-to-process materials. Hence, when TiAl alloys are processed by hot forging, isothermal forging is selected. Japanese Patent Application Publication No. Hei 6-41661 (Patent Literature 1) discloses the processing of a TiAl alloy by isothermal forging.

SUMMARY

In the isothermal forging, a TiAl alloy is processed by forging with the die and the TiAl alloy material held at substantially the same temperature, and at a low strain rate (for example, $5\times10^{-5}$/second to $5\times10^{-3}$/second). The isothermal forging like this is likely to decrease the productivity of TiAl alloy components, since the forging process at the low strain rate makes the forging speed lower.

In view of this, an object of the present disclosure is to provide a TiAl alloy whose forgeability can be improved and a method of manufacturing the same.

A TiAl alloy according to an embodiment of the present disclosure is a TiAl alloy for forging which contains 41 at % or more and 44 at or less of Al, 4 at % or more and 6 at % or less of Nb, 4 at % or more and 6 at % or less of V, 0.1 at % or more and 1 at % or less of B, and the balance being Ti and inevitable impurities.

In the TiAl alloy according to an embodiment of the present disclosure, the content of B is 0.2 at or more and 1 at or less.

In the TiAl alloy according to an embodiment of the present disclosure, the content of B is 0.5 at % or more and 1 at % or less.

The TiAl alloy according to an embodiment of the present disclosure has a metal structure in which a crystal grain size is 200 μm or less, and borides with a particle size of 100 μm or less are contained.

In the TiAl alloy according to an embodiment of the present disclosure, a metal structure includes a lamellar grain formed from an $\alpha_2$ phase of $Ti_3Al$ and a γ phase of TiAl, a γ grain of TiAl, and a B2 type grain of TiAl or a β grain of TiAl, and borides with a particle size of 0.1 μm or less are contained in at least one of the γ grain, and the B2 type grain or the β grain.

In the metal structure of the TiAl alloy according to an embodiment of the present disclosure, a volume fraction of the lamellar grain is 80 volume % or more and 95 volume % or less, a volume fraction of the γ grain is 2 volume % or more and 10 volume % or less, and a volume fraction of the B2 type grain or the β grain is 3 volume % or more and 10 volume % or less, where the volume fraction of the lamellar grain, the volume fraction of the γ grain, and the volume fraction of the B2 type grain or the β grain total 100 volume %.

A method of manufacturing a TiAl alloy according to an embodiment of the present disclosure is a method of manufacturing a TiAl alloy for forging, including a casting step of melting and casting a TiAl alloy raw material which contains 41 at % or more and 44 at % or less of Al, 4 at % or more and 6 at % or less of Nb, 4 at % or more and 6 at % or less of V, 0.1 at % or more and 1 at % or less of B, and the balance being Ti and inevitable impurities.

In the method of manufacturing a TiAl alloy according to an embodiment of the present disclosure, the content of B in the TiAl alloy raw material is 0.2 at % or more and 1 at % or less.

In the method of manufacturing a TiAl alloy according to an embodiment of the present disclosure, the content of B in the TiAl alloy raw material is 0.5 at % or more and 1 at % or less.

In the method of manufacturing a TiAl alloy according to an embodiment of the present disclosure, in the casting step, the TiAl alloy raw material does not pass through an α single phase region in a process of being cooled from its melting temperature.

In the method of manufacturing a TiAl alloy according to an embodiment of the present disclosure, in the casting step, the TiAl alloy raw material is cast to have a metal structure in which a crystal grain size is 200 μm or less, and borides with a particle size of 100 μm or less are contained.

The method of manufacturing a TiAl alloy according to an embodiment of the present disclosure further includes a forging step of forging the cast TiAl alloy at a strain rate of greater than 1/second by heating the cast TiAl alloy to 1200° C. or more and 1350° C. or less.

In the method of manufacturing a TiAl alloy according to an embodiment of the present disclosure, in the forging step, the cast TiAl alloy is held in a two-phase region of an α phase+a β phase, or a three-phase region of the α phase+the β phase++a γ phase, by being heated to 1200° C. or more and 1350° C. or less.

In the method of manufacturing a TiAl alloy according to an embodiment of the present disclosure, in the forging step, the cast TiAl alloy does not pass through the α single phase region while the temperature of the cast TiAl alloy is being raised from room temperature to 1200° C. or more and 1350° C. or less.

The method of manufacturing a TiAl alloy according to an embodiment of the present disclosure further includes a thermal treatment step of thermally treating the forged TiAl alloy. The thermal treatment step includes a recrystallization process of recrystallizing the forged TiAl alloy by heating the forged TiAl alloy to 1150° C. or more and 1350° C. or less, followed by rapid cooling, and an aging process of aging the forged TiAl alloy by heating the forged TiAl alloy to 700° C. or more and 950° C. or less for 1 hour or more and 5 hours or less after the recrystallization process.

In the method of manufacturing a TiAl alloy according to an embodiment of the present disclosure, in the recrystallization process, the forged TiAl alloy is held in the two-phase region of the α phase+the β phase, or the three-phase region of the α phase+the β phase+the γ phase, by being heated to 1150° C. or more and 1350° C. or less.

In the method of manufacturing a TiAl alloy according to an embodiment of the present disclosure, in the recrystallization process and the aging process, the forged TiAl alloy does not pass through the α single phase region.

In the method of manufacturing a TiAl alloy according to an embodiment of the present disclosure, in the thermal treatment step, the forged TiAl alloy is thermally treated to have a metal structure which includes a lamellar grain formed from an $\alpha_2$ phase of $Ti_3Al$ and a γ phase of TiAl, a γ grain of TiAl, and a B2 type grain of TiAl or a β grain of TiAl, and in which borides with a particle size of 0.1 μm or less are contained in at least one of the γ grain, and the B2 type grain or the β grain.

The thus-configured TiAl alloy for forging and the thus-configured method of manufacturing the same can improve the forgeability since they enable high-speed forging to be performed at a higher strain rate.

DESCRIPTION OF EMBODIMENTS

Figure 1:
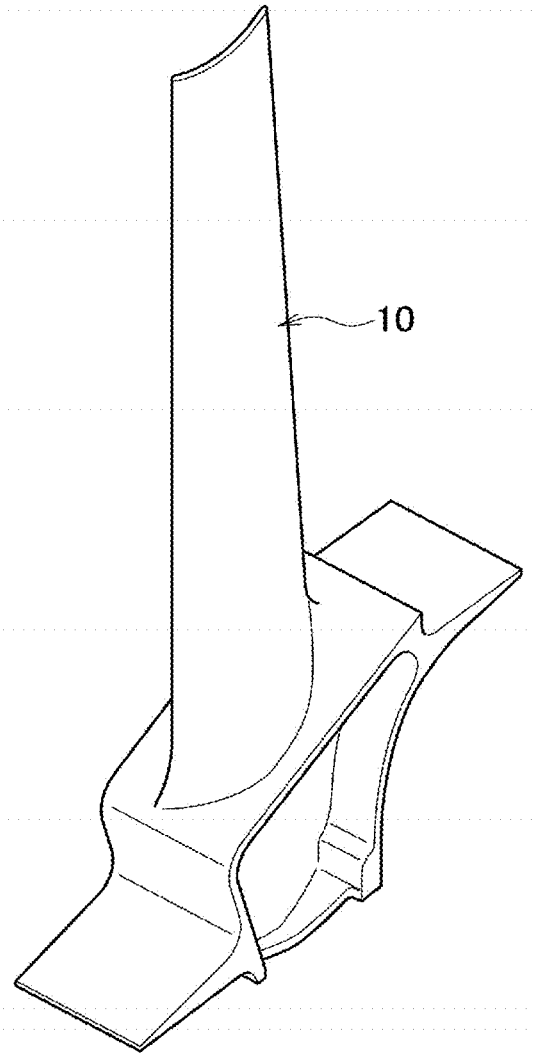
FIG. 1 is a diagram illustrating a configuration of a turbine blade according to an embodiment of the present disclosure.

Using drawings, detailed descriptions will be hereinbelow provided for an embodiment of the present disclosure.

A TiAl alloy (titanium aluminide) for forging contains 41 at % or more and 44 at % or less of Al, 4 at or more and 6 at % or less of Nb, 4 at % or more and 6 at % or less of V, 0.1 at % or more and 1 at % or less of B, and the balance being Ti and inevitable impurities. Next, an explanation will be provided for why limitations are imposed on the composition ranges of the respective alloy components contained in the TiAl alloy.

The content of Al (aluminum) in the TiAl alloy is 41 at % or more and 44 at % or less. If the content of Al therein becomes less than 41 at %, the content of Ti therein becomes larger. Thus, the specific gravity of the TiAl alloy becomes larger, and the specific strength of the TiAl alloy becomes lower. If the content of Al therein becomes greater than 44 at %, the forging temperature of the TiAl alloy becomes higher, and the forgeability of the TiAl alloy becomes lower.

Nb (niobium) is a β-phase stabilizing element, and has a function of forming a β-phase excellent in high-temperature deformation while the TiAl alloy is being forged. The content of Nb in the TiAl alloy is 4 at % or more and 6 at % or less. In the case where the content of Nb therein is 4 at % or more and 6 at % or less, the β-phase can be formed while the TiAl alloy is being forged. In addition, if the content of Nb therein becomes less than 4 at %, and if the content of Nb therein becomes greater than 6 at %, mechanical strengths of the TiAl alloy become lower.

V (vanadium) is a β-phase stabilizing element, and has a function of forming the β-phase excellent in high-temperature deformation while the TiAl alloy is being forged. The content of V in the TiAl alloy is 4 at % or more and 6 at % or less. In the case where the content of V therein is 4 at % or more and 6 at % or less, the β-phase can be formed while the TiAl alloy is being forged. In addition, if the content of V therein becomes less than 4 at %, the forgeability of the TiAl alloy becomes lower. If the content of V therein becomes greater than 6 at %, the mechanical strengths of the TiAl alloy become lower.

B (boron) has a function of refining crystal grains and thereby increasing the ductility of the TiAl alloy. The addition of B makes the ductility thereof large at 1100° C. or more and 1350° C. or less, and larger at 1200° C. or more and 1350° C. or less. Since B has the function of increasing the ductility thereof at the high temperature as discussed above, B can improve the forgeability of the TiAl alloy.

The content of B in the TiAl alloy is 0.1 at % or more and 1 at % or less. If the content of B therein becomes less than 0.1 at %, the particle size of the crystal grains becomes greater than 200 μm. Thus, the ductility of the TiAl alloy becomes lower, and the forgeability of the TiAl alloy becomes lower. If the content of B therein becomes greater than 1 at %, borides with a particle size of greater than 100 μm are formed easily while an ingot of the TiAl alloy is being formed. Thus, the ductility of the TiAl alloy becomes lower, and the forgeability of the TiAl alloy becomes lower. The borides are formed in the shape of a needle, and contain TiB, $TiB_2$ and the like. The reason why the content of B therein is 1 at % or less is that even if the content of B therein is made greater than 1 at %, the content almost does not cause further refinement of the crystal grains.

Like this, in the case where the content of B in the TiAl alloy is 0.1 at % or more and 1 at % or less, the crystal grain size of the TiAl alloy is 200 μm or less, and the TiAl alloy contains borides with a particle size of 100 μm or less. This B content, therefore, can increase the ductility of the TiAl alloy, and can improve the forgeability of the TiAl alloy. In addition, the content of B therein may be 0.2 at % or more and 1 at % or less, and may be 0.5 at % or more and 1 at % or less. This content can make the crystal grain size much smaller, can make the ductility much larger, and can make the forgeability much better.

In the case where B is added into the TiAl alloy in combination with Nb and V which are the β-phase stabilizing elements, B has a function of decreasing the deformation resistance of the TiAl alloy and improving the forgeability of the TiAl alloy while the TiAl alloy is being forged. To put it specifically, when the TiAl alloy is deformed at a strain rate of greater than 1/second, the peak stress is smaller in the case where B is added into the TiAl alloy in combination with Nb and V than in the case where B is not added into the TiAl alloy. B added in combination with Nb and V can realize high-speed forging since B makes the deformation resistance smaller even when the TiAl alloy is deformed at such a large strain rate. On the other hand, the peak stress is larger and the deformation resistance is accordingly larger in a case where B is added into the TiAl alloy in combination with other β-phase stabilizing elements (for example, in combination with Nb and Mo, in combination with Cr and Mo, or the like) than in the case where B is not added into the TiAl alloy. Thus, B added into the TiAl alloy in combination with other β-phase stabilizing elements causes forging cracks, and cannot realize high-speed forging.

B has a function of precipitating fine borides in the crystal grains and thereby increasing the mechanical strengths when subjected to a recrystallization process and an aging process in a thermal treatment step, although discussed later. The fine borides are formed inclusive of borides with a particle size of 0.1 μm or less. The fine borides contain TiB, $TiB_2$ and the like. The precipitation of the fine borides in the crystal grains can increase the mechanical strengths such as tensile strength, fatigue strength, and creep strength.

The TiAl alloy may contain inevitable impurities such as O (oxygen) and N (nitrogen).

Next, descriptions will be provided for a method of manufacturing a TiAl alloy for forging.

The method of manufacturing a TiAl alloy for forging includes a casting step of melting and casting a TiAl alloy raw material which contains 41 at % or more and 44 at % or less of Al, 4 at % or more and 6 at % or less of Nb, 4 at % or more and 6 at % or less of V, 0.1 at % or more and 1 at % or less of B, and the balance being Ti and inevitable impurities.

An ingot or the like is formed in a vacuum induction furnace or the like by melting and casting the TiAl alloy raw material which contains 41 at % or more and 44 at % or less of Al, 4 at % or more and 6 at % or less of Nb, 4 at % or more and 6 at % or less of V, 0.1 at % or more and 1 at % or less of B, and the balance being Ti and inevitable impurities. The casting of the TiAl alloy raw material may use a casting system used to cast a general metallic material. In addition, the content of B in the TiAl alloy raw material may be 0.2 at % or more and 1 at % or less, and may be 0.5 at % or more and 1 at % or less.

The cast TiAl alloy has an alloy composition in which the cast TiAl alloy contains 41 at % or more and 44 at % or less of Al, 4 at % or more and 6 at % or less of Nb, 4 at % or more and 6 at % or less of V, 0.1 at % or more and 1 at % or less of B, and the balance being Ti and inevitable impurities. The cast TiAl alloy, therefore, does not pass through an α single phase region in a process of being cooled from its melting temperature. If the cast TiAl passed through the α single phase region, the crystal grains of the cast TiAl alloy would become coarse and the ductility of the cast TiAl alloy would accordingly decrease. Since the cast TiAl alloy does not pass through the α single phase region, the coarsening of the crystal grains is inhibited.

The cast TiAl alloy has a metal structure in which the crystal grain size is 200 μm or less, and borides with a particle size of 100 μm or less are contained. The borides are formed in the shape of a needle, and contain TiB, $TiB_2$ and the like. Like this, the metal structure of the cast TiAl alloy includes fine crystal grains with the crystal grain size of 200 μm or less, and contains borides with a particle size of 100 μm or less. The forgeability thereof can be improved.

The method of manufacturing a TiAl alloy for forging may include a forging step of forging the cast TiAl alloy at a strain rate of greater than 1/second by heating the cast TiAl alloy to 1200° C. or more and 1350° C. or less.

The cast TiAl alloy is held in a two-phase region of an α phase+a β phase, or a three-phase region of the α phase+the β phase+a γ phase, by being heated to 1200° C. or more and 1350° C. or less. Since the heated TiAl alloy includes the β phase which is excellent in high-temperature deformation, the heated TiAl alloy is easily deformed. In addition, the cast TiAl alloy does not pass through the α single phase region while the temperature of the cast TiAl alloy is being raised from room temperature to 1200° C. or more and 1350° C. or less. Since the cast TiAl alloy does not pass through the α single phase region, the coarsening of the crystal grains is inhibited, and a decrease in the ductility of the cast TiAl alloy is inhibited. Accordingly, the forgeability of the cast TiAl alloy can be improved.

The cast TiAl alloy is forged at a strain rate of greater than 1/second while held at 1200° C. or more and 1350° C. or less. Even though the cast TiAl alloy is forged at a strain rate of greater than 1/second, forging cracks can be inhibited since the peak stress is small and the deformation resistance is small. The strain rate during the forging may be, for example, more than 1/second and 10/second or less, or 10/second or more. The forging may be performed in an atmosphere of an inert gas such as an argon gas for the purpose of oxidation prevention. The forging method may be a general metallic material forging method such as free-forging, die forging, roll forging and extrusion, and may use a general metallic material forging system for performing the method. After the forging, the forged TiAl alloy is cooled slowly by furnace cooling or the like. While slowly cooled, too, the forged TiAl alloy does not pass through the α single phase region. The coarsening of the crystal grains is inhibited.

The method of manufacturing a TiAl alloy for forging may include a thermal treatment step of thermally treating the forged TiAl alloy. The thermal treatment step includes a recrystallization process of heating the forged TiAl alloy to 1150° C. or more and 1350° C. or less, followed by rapid cooling, and an aging process of aging the forged TiAl alloy by heating the forged TiAl alloy to 700° C. or more and 950° C. or less for 1 hour or more and 5 hours or less after the recrystallization process.

The recrystallization process is a process of recrystallizing the forged TiAl alloy by heating the forged TiAl alloy to 1150° C. or more and 1350° C. or less, followed by rapid cooling. The forged TiAl alloy is held in the two-phase region of the α phase+the β phase, or the three-phase region of the α phase+the β phase+the γ phase, by being heated to 1150° C. or more and 1350° C. or less. Thereafter, the forged TiAl alloy is rapidly cooled from this region. A time length for which the forged TiAl alloy is held at the heating temperature may be 0.5 hours or more and 5 hours or less. Since the forged TiAl alloy is strained by the forging, the crystal grains can be refined through the recrystallization. After the recrystallization process, the metal structure comes to include the α phase+the β phase, or the α phase+the β phase+the γ phase, since the forged TiAl alloy is rapidly cooled from the two-phase region of the α phase+the β phase, or the three-phase region of the α phase+the β phase+the γ phase.

The aging process is a process of aging the TiAl alloy by heating the TiAl alloy to 700° C. or more and 950° C. or less for 1 hour or more and 5 hours or less after the recrystallization process. The aging process makes the α phase become an equiaxed lamellar grain which is formed from $\alpha_2$ phases of $Ti_3Al$ and γ phases of TiAl. The lamellar grain is a multilayered grain formed from $\alpha_2$ phases and γ phases which are regularly arranged one after another. The β phase becomes a B2 type grain (a so-called CsCl type crystal structure) or a β grain. Otherwise, the β phase becomes the B2 type grain or the β grain, and the γ grain (the B2 type grain and the γ grain, or the β grain and the γ grain). The γ-phase becomes the γ grain. Furthermore, the aging process precipitates fine borides with a particle size of 0.1 μm or less in the crystal grains. The fine borides are formed from TiB, $TiB_2$ and the like.

The recrystallization process and the aging process may be performed in an atmosphere of an inert gas such as an argon gas for the purpose of oxidation prevention. The recrystallization process and the aging process may be performed using an atmosphere furnace or the like which is used for a general metallic material thermal treatment. Furthermore, in the recrystallization process and the aging process, the forged TiAl alloy does not pass through the α single phase region. Thus, the coarsening of the crystal grains is inhibited, and the mechanical strengths are improved.

Next, descriptions will be provided for the metal structure of the thermally-treated TiAl alloy. The metal structure of the thermally-treated TiAl alloy includes the lamellar grain which is formed from $\alpha_2$ phases of $Ti_3Al$ and γ phases of TiAl, the γ grain of TiAl, and the B2 type grain of TiAl or the β grain of TiAl. Borides with a particle size of 0.1 μm or less are contained in at least one of the γ grain, and the B2 type grain or the β grain.

The metal structure of the thermally-treated TiAl alloy includes mainly the equiaxed lamellar grain. In the metal structure of the thermally-treated TiAl alloy, a volume fraction of the lamellar grain is 80 volume % or more and 95 volume % or less, a volume fraction of the γ grain is 2 volume % or more and 10 volume % or less, and a volume fraction of the B2 type grain or the β grain is 3 volume % or more and 10 volume % or less, where the volume fraction of the lamellar grain, the volume fraction of the γ grain, and the volume fraction of the B2 type grain or the β grain total 100 volume %. Since like this, the metal structure of the thermally-treated TiAl alloy includes mainly the equiaxed lamellar grain, the mechanical strengths such as the tensile strength, the fatigue strength and the creep strength can be improved.

Furthermore, in the metal structure of the thermally-treated TiAl alloy, borides with a particle size of 0.1 μm or less are precipitated in at least one of the γ grain, and the B2 type grain or the β grain. The borides may be precipitated in the γ grain, or the B2 type grain or the β grain. Otherwise, the borides may be precipitated in the γ grain, and the B2 type grain or the β grain. The particle size of the borides is 0.1 μm or less. The borides include TiB, $TiB_2$ and the like. Since the borides with a particle size of 0.1 μm or less are precipitated, the mechanical strengths can be improved further.

The above-discussed TiAl alloy for forging may be used for aircraft engine components such as a turbine blade. FIG. 1 is a diagram illustrating a configuration of the turbine blade 10. The turbine blade 10 and the like can be manufactured by high-speed hot forging at a strain rate of greater than 1/second. Thus, the productivity of components such as the turbine blade 10 can be improved.

As discussed above, the thus-configured TiAl alloy for forging contains 41 at % or more and 44 at % or less of AI, 4 at % or more and 6 at % or less of Nb, 4 at % or more and 6 at % or less of V, 0.1 at % or more and 1 at % or less of B, and the balance being Ti and inevitable impurities. The TiAl alloy for forging, therefore, can be subjected to the high-speed forging at a strain rate of greater than 1/second, and the forgeability of the TiAl alloy for forging is improved.

Examples

To begin with, descriptions will be provided for TiAl alloys of Examples 1 to 4 and Comparative Examples 1 to 4. Table 1 shows alloy compositions of the respective TiAl alloys.

TABLE 1

| | ALLOY COMPOSITION (at %) | | | | | |
|---|---|---|---|---|---|---|
| | Al | Nb | V | Mo | B | Ti + IMPURITIES |
| EXAMPLE 1 | 43 | 4 | 5 | — | 0.1 | BALANCE |
| EXAMPLE 2 | 43 | 4 | 5 | — | 0.2 | BALANCE |
| EXAMPLE 3 | 43 | 4 | 5 | — | 0.5 | BALANCE |
| EXAMPLE 4 | 43 | 4 | 5 | — | 1 | BALANCE |
| COMPARATIVE EXAMPLE 1 | 43 | 4 | 5 | — | 2 | BALANCE |
| COMPARATIVE EXAMPLE 2 | 43 | 4 | 5 | — | — | BALANCE |
| COMPARATIVE EXAMPLE 3 | 43 | 5 | — | 5 | — | BALANCE |
| COMPARATIVE EXAMPLE 4 | 43 | 5 | — | 5 | 0.2 | BALANCE |

The alloys of Examples 1 to 4 and Comparative Example 1 and 2 each contained 43 at % of Al, 4 at % of Nb, and 5 at % of V. The contents of B in the alloys of Examples 1 to 4 and Comparative Example 1 to 2 were made different from one another. The alloy of Example 1 contained 0.1 at % of B. The alloy of Example 2 contained 0.2 at % of B. The alloy of Example 3 contained 0.5 at % of B. The alloy of Example 4 contained 1 at % of B. Meanwhile, the alloy of Comparative Example 1 contained 2 at % of B, and the alloy of Comparative Example 2 did not contain B (contained 0 at % of B).

The alloys of Comparative Examples 3 and 4 each contained 43 at % of Al, 5 at % of Nb, and 5 at % of Mo. The contents of B in the alloys of Comparative Examples 3 and 4 were made different from each other. The alloy of Comparative Example 3 did not contain B (contained 0 at % of B). The alloy of Comparative Example 4 contained 0.2 at % of B.

The TiAl alloy raw materials with the respective alloy compositions shown in Table 1 were melted and cast in a high-frequency vacuum melting furnace. Thereby, ingots of the TiAl alloy raw materials with the respective alloy compositions were formed.

Figure 2:
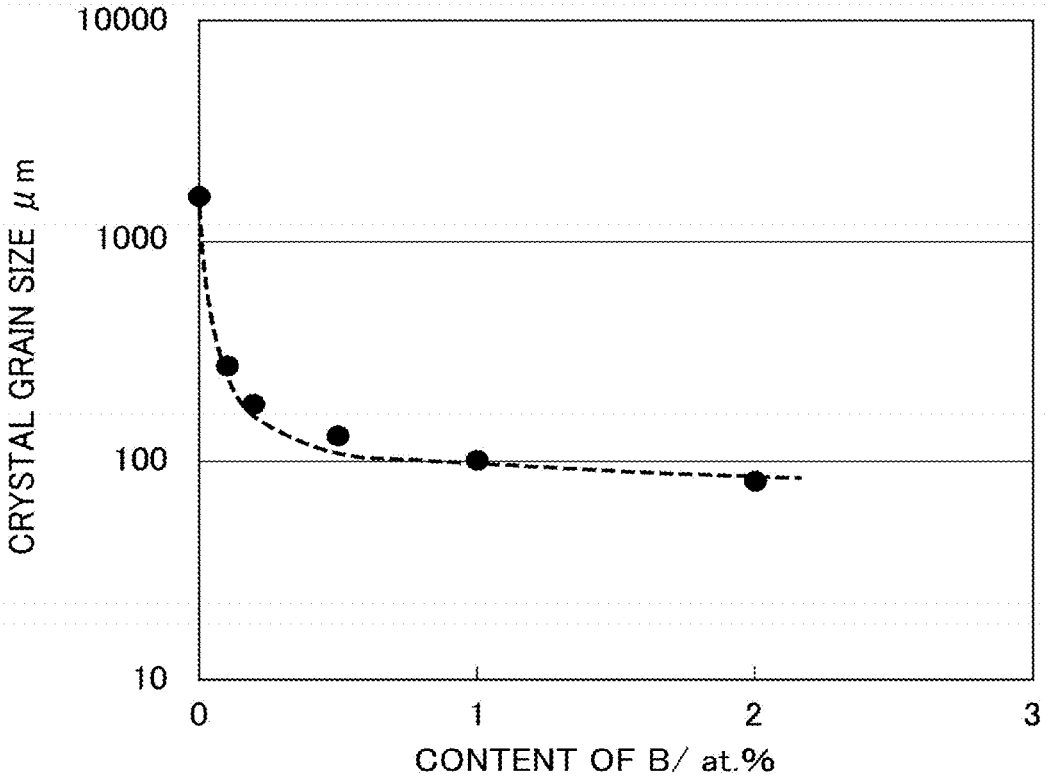
FIG. 2 is a graph showing a result of measuring a crystal grain size of each alloy in the embodiment of the present disclosure.

For each of the cast alloys of Examples 1 to 4 and Comparative Example 1 and 2, its metal structure was observed with a scanning electron microscope (SEM), and its crystal grain size was measured. FIG. 2 is a graph showing a result of measuring the crystal grain sizes of the respective alloys. In FIG. 2, the horizontal axis represents the contents of B in the respective alloys, while the vertical axis represents the crystal grain sizes of the respective alloys. The crystal grain size of each alloy is marked with a black circle.

It was obtained that the crystal grain size tended to become smaller as the content of B became larger. The crystal grain size of the alloy of Comparative Example 2 was greater than 1000 μm. In contrast to this, the crystal grain sizes of the alloys of Examples 1 to 4 and Comparative Example 1 were 200 μm or less. Furthermore, the crystal grain size of the alloy whose content of B was greater than 1 at % was substantially equal to that of the alloy of whose content B was 1 at %, and almost no further refining effect was obtained from the alloy whose content of B was greater than 1 at %.

Figure 3:
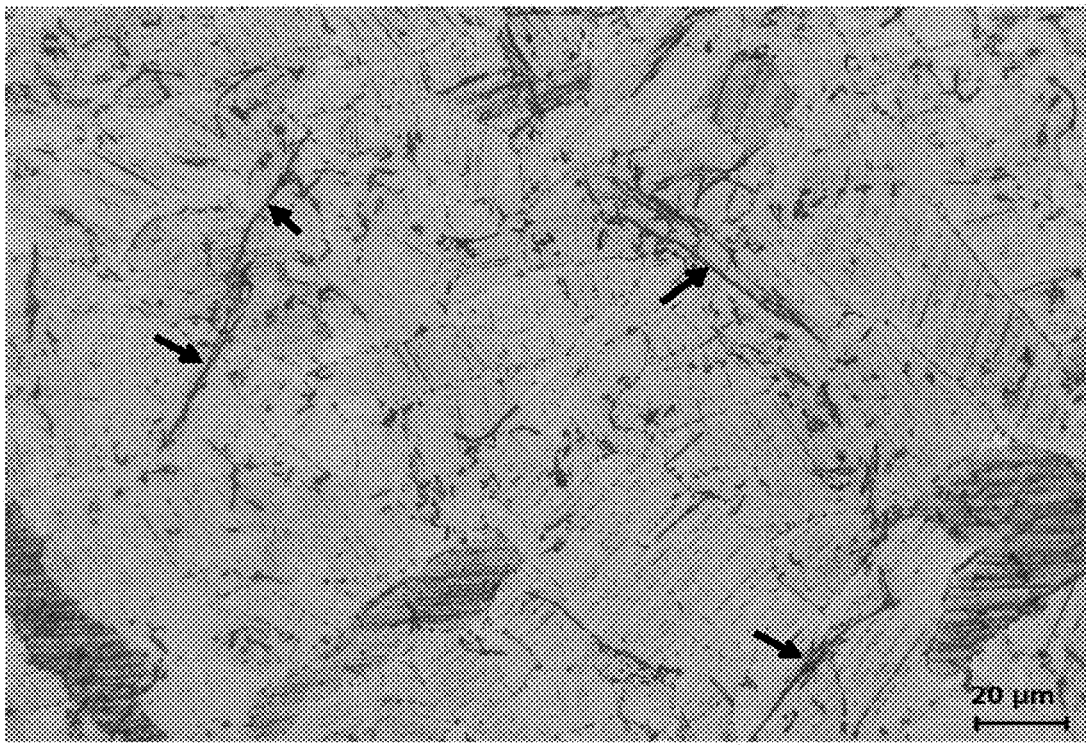
FIG. 3 is a photograph showing a result of observing a metal structure of an alloy of Example 4 in the embodiment of the present disclosure.

FIG. 3 is photograph showing a result of observing the metal structure of the alloy of Example 4. As indicated with arrows, borides with a particle size of 100 μm or less were observed as being precipitated in the metal structure of the alloy of Example 4. From this, it was learned that in the case where the content of B was greater than 1 at %, coarse borides with a particle size of greater than 100 μm were precipitated easily to increase possibility that the ductility and toughness of the alloy deteriorated.

From this result, it was learned that the cast TiAl alloys with a boron content of 0.1 at % or more and 1 at % or less had their respective crystal grain sizes of 200 μm or less, and the cast TiAl alloys contained borides with a particle size of 100 μm or less as precipitates. Furthermore, it became clear that the crystal gain size was able to be made smaller by limiting the boron content to 0.2 at % or more and 1 at % or less, and to 0.5 at % or more and 1 at or less.

Next, peak stresses of the alloys of Example 2 and Comparative Examples 2 to 4 were measured for the purpose of evaluating their deformation resistances during the forging. To begin with, descriptions will be provided for how to measure peak stresses. At each of strain rates of 0.01/second, 0.1/second, 1/second and 10/second, a compression test was performed on each alloy until the true strain became equal to 1.2 to obtain a true stress-true strain curve, and a maximum stress was used as the peak stress. The strain rates were based on the true strain. The test temperature was 1200° C.

Figure 4:
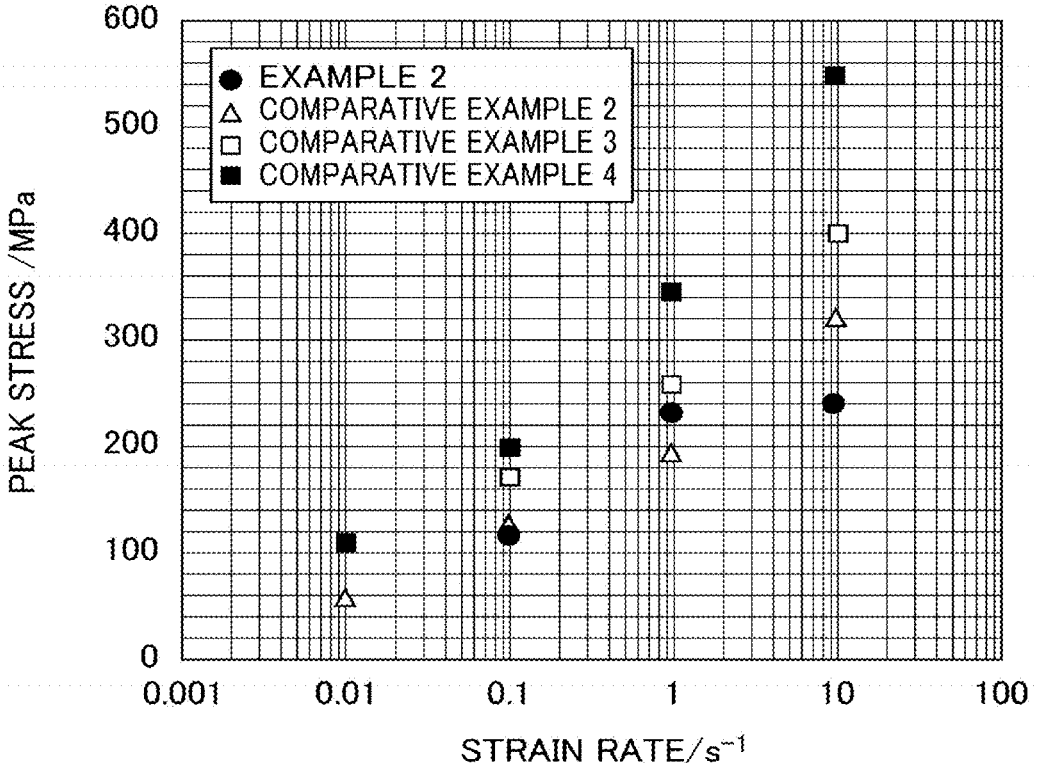
FIG. 4 is a graph showing a result of measuring peak stresses of each alloy in the embodiment of the present disclosure.

FIG. 4 is a graph showing a result of measuring the peak stresses of each alloy. In the graph in FIG. 4, the horizontal axis represents strain rates, while the vertical axis represents peak stresses. The peak stresses of the alloy of Example 2 are marked with a black circle. The peak stresses of the alloy of Comparative Example 2 are marked with a white triangle. The peak stresses of the alloy of Comparative Example 3 are marked with a white square. The peak stresses of the alloy of Comparative Example 4 are marked with a black square.

When the strain rate was 1/second or less, the peak stress of the alloy of Example 2 was equal to the peak stress of the alloy of Comparative Example 2. When the strain rate was 10/second, the peak stress of the alloy of Example 2 was smaller than the peak stress of the alloy of Comparative Example 2. From this, it was learned that when the strain rate was greater than 1/second, the peak stress of the alloy of Example 2 was smaller than the peak stress of the alloy of Comparative Example 2. Furthermore, in the alloy of Example 2, the peak stress at a strain rate of 1/second is equal to the peak stress at a strain rate of 10/second, and almost no increase in the peak stress was observed although the strain rate increased beyond 1/second. From this result, it was learned that when the strain rate was greater than 1/second, the peak stress was smaller in the case where the alloy composition included B than in the case where the alloy composition included no B, and the inclusion of B was able to make the deformation resistance during the forging smaller than the exclusion of B.

The peak stress of the alloy of Comparative Example 3 was compared with the peak stress of the alloy of Comparative Example 4. Although the alloy composition of the alloy of Comparative Example 4 contained B, no decrease in the peak stress was observed in the alloy of Comparative Example 4. In the alloy of Comparative Example 4, an increase in the peak stress was observed even from the peak stress at the strain rate of 1/second to the peak stress at the strain rate of greater than 1/second. From this result, it was learned that the addition of B was effective in the case where the alloy composition contained Nb and V, and not effective in the case where the alloy composition contained Nb and Mo.

Figure 5:
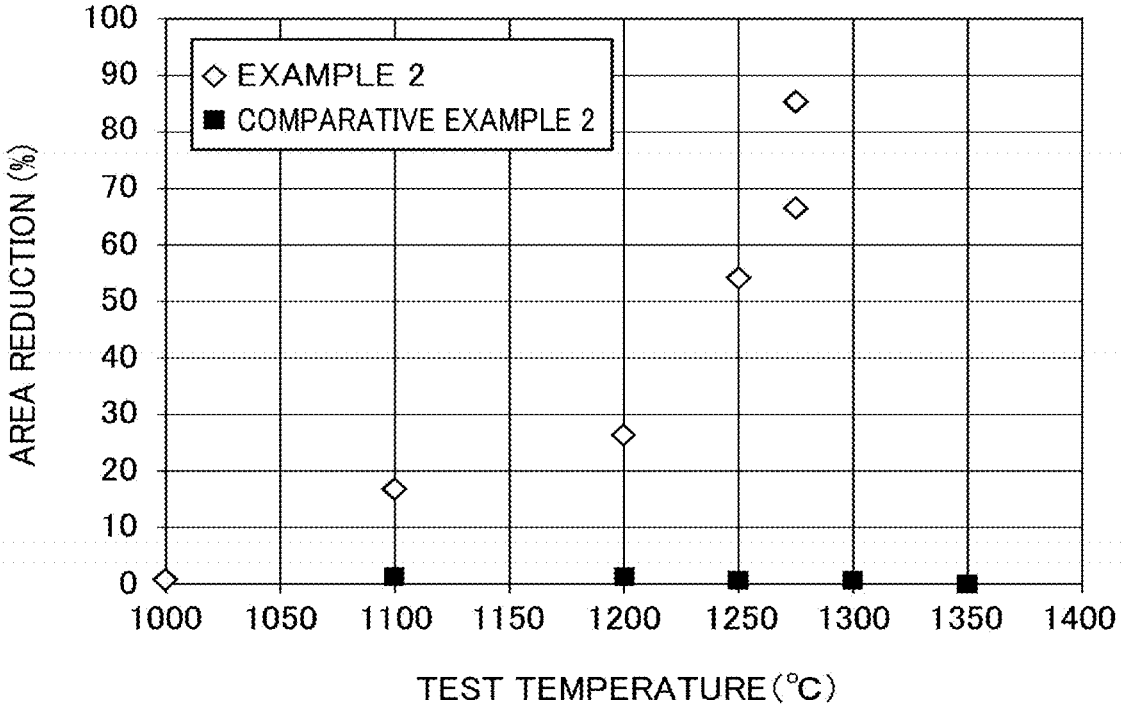
FIG. 5 is a graph showing a result of measuring area reductions of each alloy in the embodiment of the present disclosure.

Next, a tensile test was performed on the alloys of Example 2 and Comparative Example 2 using a Gleeble testing machine to measure area reductions of each alloy. The test temperature for the area reduction was from 1000° C. to 1350° C. For each alloy, area reductions were calculated by measuring the cross-sectional area reduction rates of the fractured parts of the fracture materials. FIG. 5 is a graph showing a result of measuring the area reductions of each alloy. In FIG. 5, the horizontal axis represents the test temperatures, while the vertical axis represents the area reductions. The area reductions of the alloy of Example 2 are marked with a white diamond, while the area reductions of the alloy of Comparative Example 2 are marked with a black square.

From 1100° C. to 1350° C., the area reduction of the alloy of Example 2 was larger than the area reduction of the alloy of Comparative Example 2. From this result, it was learned that the addition of B into the alloy composition improved the ductility. It was learned that the area reduction of the alloy of Example 2 became larger as the temperature increased from 1200° C. to 1350° C., and much larger as the temperature increased from 1250° C. to 1350° C. Meanwhile, the area reduction of the alloy of Comparative Example 2 was substantially equal to 0% from 1000° C. to 1350° C., and the ductility of the alloy of Comparative Example 2 was small.

Next, the cast alloy of Example 2 was held in the two-phase region of the α phase and the β phase by being heated to 1200° C., and was subjected to press forging at a strain rate of 10/second. After the press forging, the forged alloy of Example 2 was slowly cooled to room temperature by furnace cooling. The outer appearance of the forged alloy of Example 2 was observed, and no forging cracks or the like were observed.

The forged alloy of Example 2 was subjected to the thermal treatment including the recrystallization process and the aging process. In the recrystallization process, the forged alloy of Example 2 was held in the two-phase region of the α phase and the β phase by being heated to 1150° C. or more and 1350° C. or less for 0.5 hours or more and 5 hours or less, and thereafter was rapidly cooled to room temperature by air cooling. In the aging process, the recrystallized alloy of Example 2 was aged by being heated to 700° C. or more and 950° C. or less for 1 hour or more and 5 hours or less after the recrystallization process.

Figure 6:
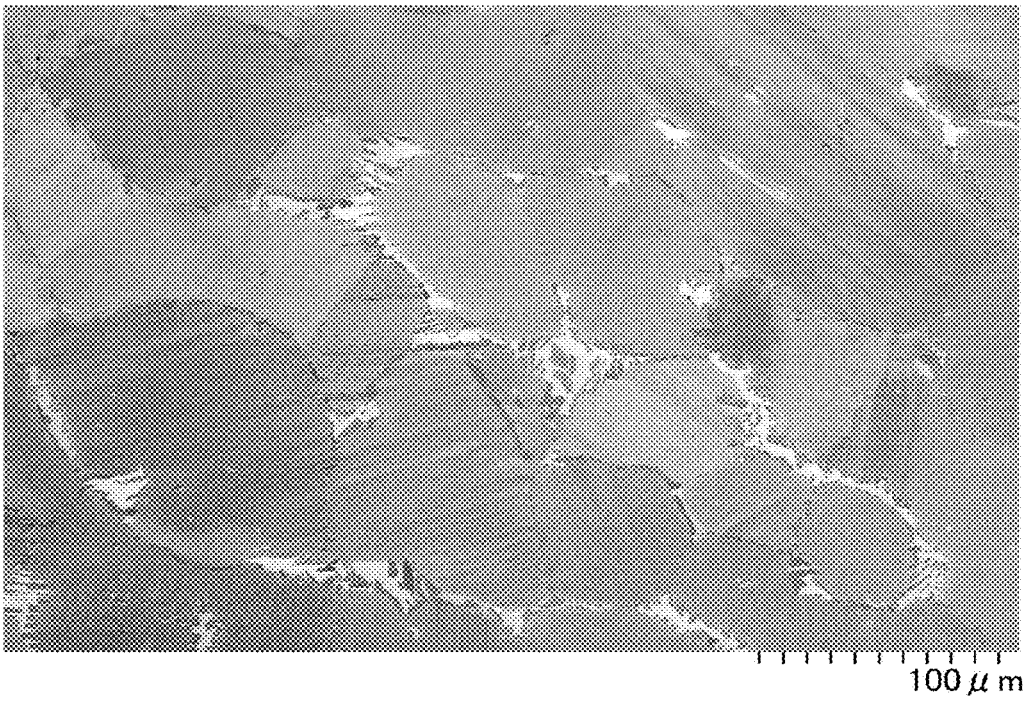
FIG. 6 is a photograph showing a result of observing a metal structure of a thermally-treated alloy of Example 2 in the embodiment of the present disclosure.

The metal structure of the thermally-treated alloy of Example 2 was observed with a scanning electron microscope (SEM) FIG. 6 is a photograph showing a result of observing the metal structure of the thermally-treated alloy of Example 2. The metal structure of the thermally-treated alloy of Example 2 included a lamellar grain formed from $\alpha_2$ phases of $Ti_3Al$ and γ phases of TiAl, a γ grain of TiAl, and a B2 type grain (a so-called CsCl type crystal structure) of TiAl or a β grain of TiAl. The lamellar grain was the main component. In the metal structure of the thermally-treated alloy of Example 2, a volume fraction of the lamellar grain was 80 volume % or more and 95 volume or less, a volume fraction of the γ grain was 2 volume % or more and 10 volume % or less, and a volume fraction of the B2 type grain or the β grain was 3 volume % or more and 10 volume % or less, where the volume fraction of the lamellar grain, the volume fraction of the γ grain, and the volume fraction of the B2 type grain or the β grain totaled 100 volume %. Incidentally, the volume fractions of the respective grains were substituted with area ratios of the grains which were obtained by processing contrast image information on the grains in a scanning electron microscope (SEM) photograph.

Figure 7:
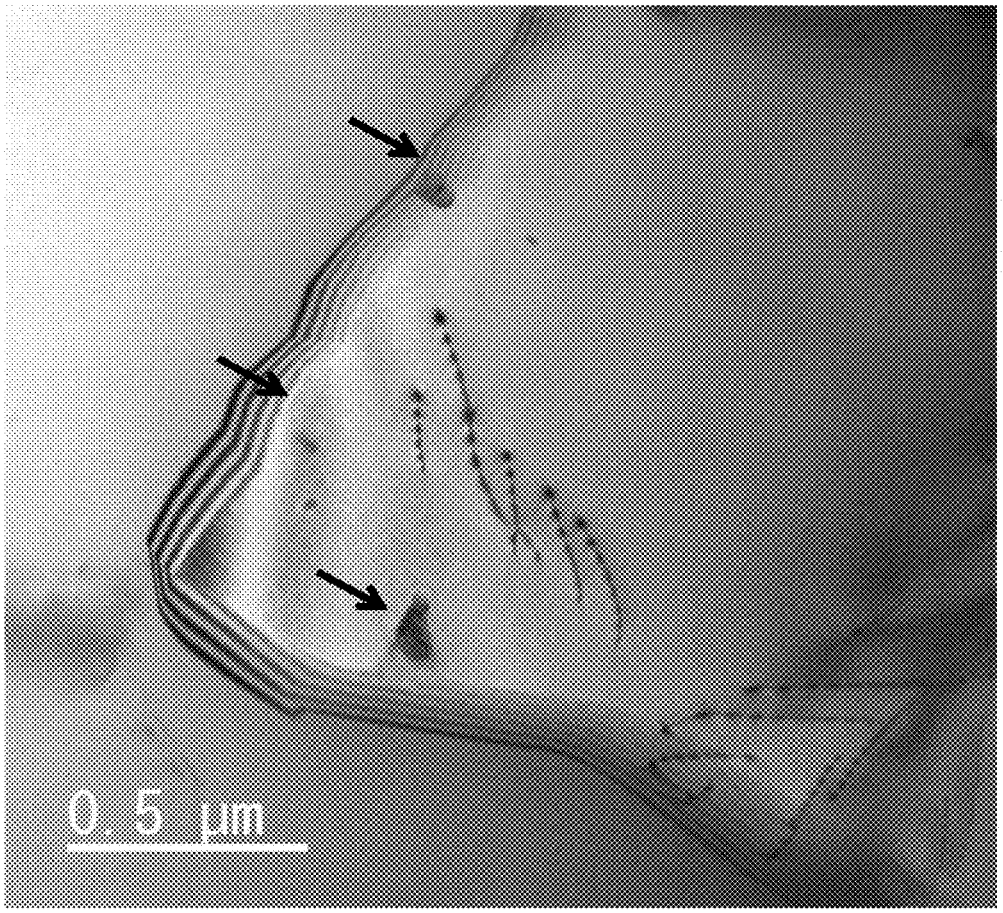
FIG. 7 is a photograph showing a result of observing precipitated borides in the embodiment of the present disclosure.

Furthermore, in the metal structure of the thermally-treated alloy of Example 2, borides were precipitated in at least one of the γ grain, and the B2 type grain or the β grain. FIG. 7 is a photograph showing a result of observing the precipitated borides. As indicated with arrows in FIG. 7, a particle size of the borides was 0.1 μm or less.

Figure 8:
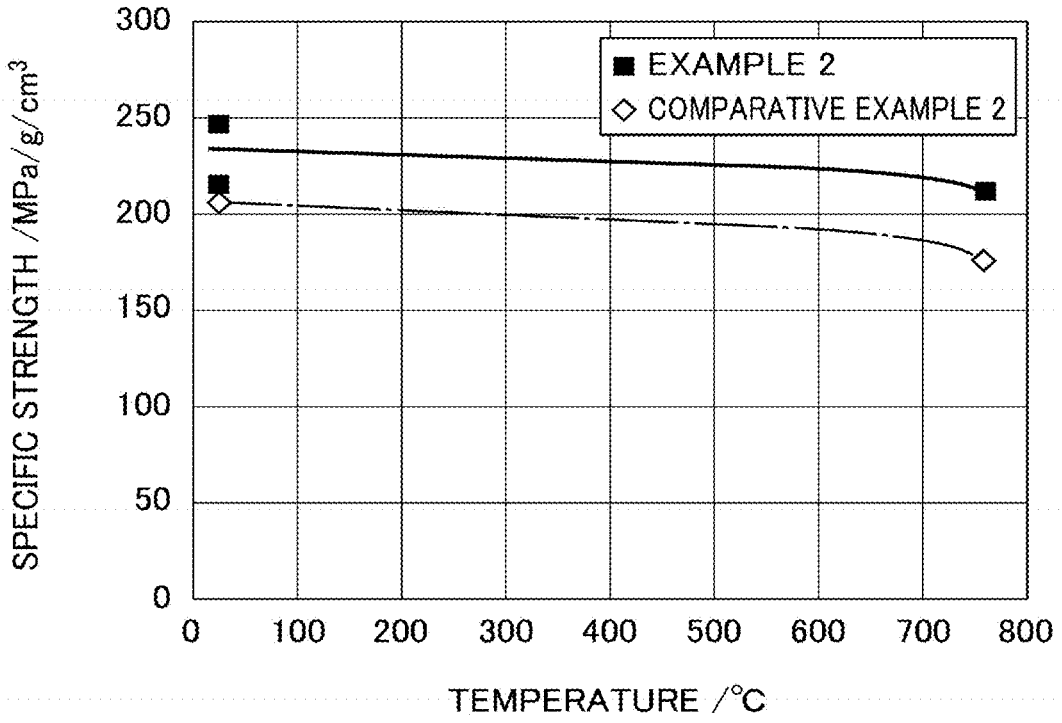
FIG. 8 is a graph showing a tensile property of each alloy in the embodiment of the present disclosure.

Thereafter, the strength property of the thermally-treated alloy of Example 2 was evaluated by a tensile test. Similarly, the strength property of the alloy of Comparative Example 2 was evaluated by the tensile test. Incidentally, the alloy of Comparative Example 2 was not forged after the casting, and was thermally treated in the same as the alloy of Example 2 was. FIG. 8 is a graph showing the tensile property of each alloy. In FIG. 8, the horizontal axis represents the test temperature, while the vertical axis represents the specific strength. The alloy of Example 2 is marked with a black square, while the alloy of Comparative Example 2 is marked with a white diamond. The room-temperature strength and the high-temperature strength of the thermally-treated alloy of Example 2 were larger than those of the alloy of Comparative Example 2. From this result, it was learned that the addition of B into the alloy composition improved the mechanical strengths.

The present disclosure enables the high-speed forging to be performed at a higher strain rate, and improves the forgeability. The disclosure, therefore, is useful for aircraft engine components such as a turbine blade.

What is claimed is:

1. A TiAl alloy, consisting of:

Ti;

Al in a range of from 41 to 44 at. %;

Nb in a range of from 4 to 6 at. %;

V in a range of from 4 to 6 at. %;

B in a range of from 0.5 to 1 at. %; and inevitable impurities, wherein the alloy is suitable for forging, wherein the alloy has a composition which does not pass through an α-Ti single phase region between a melting point and a room temperature, wherein the alloy comprises a metal structure having a crystal grain size of 200 μm or less, and wherein the metal structure consists of a lamellar grain formed from an $\alpha_2$ phase of $Ti_3Al$ and a γ phase of TiAl; a γ grain of TiAl; a B2 type grain of TiAl or a β grain of TiAl; borides with a particle size of 0.1 μm or less precipitated in the γ grain, and/or the B2 type grain or the β grain; and inevitable impurities.

2. The alloy of claim 1, wherein relative to a total of only the volume fraction of the lamellar grain, the volume fraction of the γ grain, and the volume fraction of the B2 type grain or the β grain being 100 vol. %:

the lamellar grain in a volume fraction in a range of from 80 to 95 vol. %;

the γ grain in a volume fraction of from 2 to 10 vol. %, and the B2 type grain or the β grain in a volume fraction of from 3 to 10 vol. %.

3. The alloy of claim 1, wherein the metal structure consists of:

a lamellar grain formed from an $\alpha_2$ phase of $Ti_3Al$ and a γ phase of TiAl;

a γ grain of TiAl;

a β grain of TiAl;

borides with a particle size of 0.1 μm or less precipitated in the γ grain and/or the β grain; and inevitable impurities.

4. The alloy of claim 3, wherein relative to a total of only the volume fraction of the lamellar grain, the volume fraction of the γ grain, and the volume fraction of the β grain being 100 vol. %:

the lamellar grain in a volume fraction of from 80 to 95 vol. %;

the γ grain in a volume fraction of from 2 to 10 vol. %, and the β grain in a volume fraction of from 3 to 10 vol. %.

5. The alloy of claim 1, wherein the borides are needle-shaped and comprise TiB and $TiB_2$.

6. The alloy of claim 1, wherein the Al is present in a range of from 41 to 43 at. %.

7. The alloy of claim 1, wherein the Al is present in a range of from greater than 43 to less than 44 at.%.

8. The alloy of claim 1, wherein the Nb is present at 4 at. %.

9. The alloy of claim 1, wherein the V is present in a range of from 4 to 5 at. %.

10. The alloy of claim 1, wherein the V is present in a range of from greater than 5 to 6 at. %.

11. A forged part, comprising the alloy of claim 1.

12. A forged engine component, comprising the alloy of claim 1.

13. A forged aircraft engine turbine blade, comprising the alloy of claim 1.

* * * * *